United States Patent [19]

Strassle

[11] 4,365,839

[45] Dec. 28, 1982

[54] CHAIR CONSTRUCTION WITH PROTECTIVE CUSHIONING FOR EXPOSED STRUCTURAL PROJECTIONS

[75] Inventor: Alex Strassle, Kirchberg, Switzerland

[73] Assignee: Intercollection Development SA, Kirchberg, Switzerland

[21] Appl. No.: 843,303

[22] Filed: Oct. 18, 1977

[30] Foreign Application Priority Data

Jul. 11, 1977 [CH] Switzerland ..... 8531/77

[51] Int. Cl.[3] ..... A47C 7/54; A47B 91/00

[52] U.S. Cl. ..... 297/411; 248/188.7; 248/345.1

[58] Field of Search ..... 248/345.1, 188.7; 297/411

[56] References Cited

U.S. PATENT DOCUMENTS

| | | | |
|---|---|---|---|
| 2,217,754 | 10/1940 | Johnson | 248/345.1 X |
| 2,292,445 | 8/1942 | Hilldring | 248/345.1 |
| 2,690,212 | 9/1954 | Takeway | 248/345.1 X |
| 3,289,995 | 12/1966 | Taylor | 248/345.1 |
| 3,634,925 | 1/1972 | Van Loo | 297/411 X |
| 3,643,905 | 2/1972 | Kint | 248/345.1 |
| 3,869,106 | 3/1975 | Gregov | 248/345.1 |
| 4,226,464 | 10/1980 | Janz et al. | 297/411 X |

*Primary Examiner*—Roy D. Frazier

*Attorney, Agent, or Firm*—Sughrue, Mion, Zinn, Macpeak & Seas

[57] ABSTRACT

The armrests and base feet of a chair are encased by a soft cushioning layer of foamed plastic, such as polyurethane, to provide bumping and impact protection and to enable the structural support members of the chair to be fabricated from rough and unfinished metal stock.

4 Claims, 3 Drawing Figures

CHAIR CONSTRUCTION WITH PROTECTIVE CUSHIONING FOR EXPOSED STRUCTURAL PROJECTIONS

BACKGROUND OF THE INVENTION

This invention relates to a chair construction wherein the structural support members are encased by a soft cushioning layer of foamed plastic or the like.

In prior art open chairs or arm chairs the seating bowl typically consists of an approximately horizontal seating surface and a backrest, the latter being integral with the seating surface or separately supported adjacent thereto as an individual component and sometimes adjustable in height. In many arm chairs a headrest has also been disposed above the backrest, again either integral therewith or separately adjustable in height. The legs or foot supports of such chairs are found in many different forms according to both practical and stylistic or appearance considerations. Thus, for example, both open chairs and arm chairs with four conventional legs or with a central column support and radially extending feet are known, both with or without rollers or casters mounted on the ends of such legs or feet.

In the case of office furniture for desks or typewriter tables the central support column construction with a star-shaped foot configuration, typically having five projecting feet, has been widely adopted. The advantages of such a construction are that the seating surface can easily be adjusted as to height and/or tilt resiliency about a vertical axis, and because a five footed configuration offers a relatively large support base area and is less prone to tipping as when the occupant's center of gravity falls outside of the base area.

To increase the support base area the foot projections are often extended up to 10 centimeters or more beyond or outside of the peripheral area of the seating bowl. When such chairs are equipped with rollers or casters, however, a disadvantage arises in that the projecting ends of the feet often strike and damage other furniture, walls, etc. when the position of the chair is carelessly shifted or moved. Such lengthy feet must also be constructed in a very solid and sturdy manner in order to effectively transmit the weight of the occupant acting on the center support post or column out to the floor engaging rollers or casters at the extremities of the feet. Such foot constructions often involve bent metal stock shaped according to aesthetic considerations, either square or rectangular in cross-section with rounded edges. Despite such edge rounding, however, the rigid metal projections often injuriously strike the feet or ankles of the occupant.

SUMMARY OF THE INVENTION

An object of the present invention is thus to provide a chair construction which avoids the drawbacks and disadvantages of the prior art noted above, and which particularly avoids or mitigates any damage to the user or adjacent walls or furniture owing to impact by or against the structural elements of the chair. Thus, according to the present invention a chair is constructed of hard metal or the like support elements whose outer surface contours are protectively covered by a layer of soft elastic cushioning material, such as foamed polyurethane. With respect to a typical office chair having a central support column and star-shaped foot members, at least the outwardly projecting free ends of the feet are covered with elastic material to cushion the sides, outer end and top surfaces of the feet, and when armrests are provided these are also protectively encased in a soft elastic material. The foot projections are advantageously encased on all sides and over their entire lengths both to enhance their overall aesthetic appearance and also to avoid any damage or injury to the occupant by striking his shoes or ankles against the feet or legs of the chair.

DETAILED DESCRIPTION OF THE PREFERRED EMBODIMENT

Figure 1:
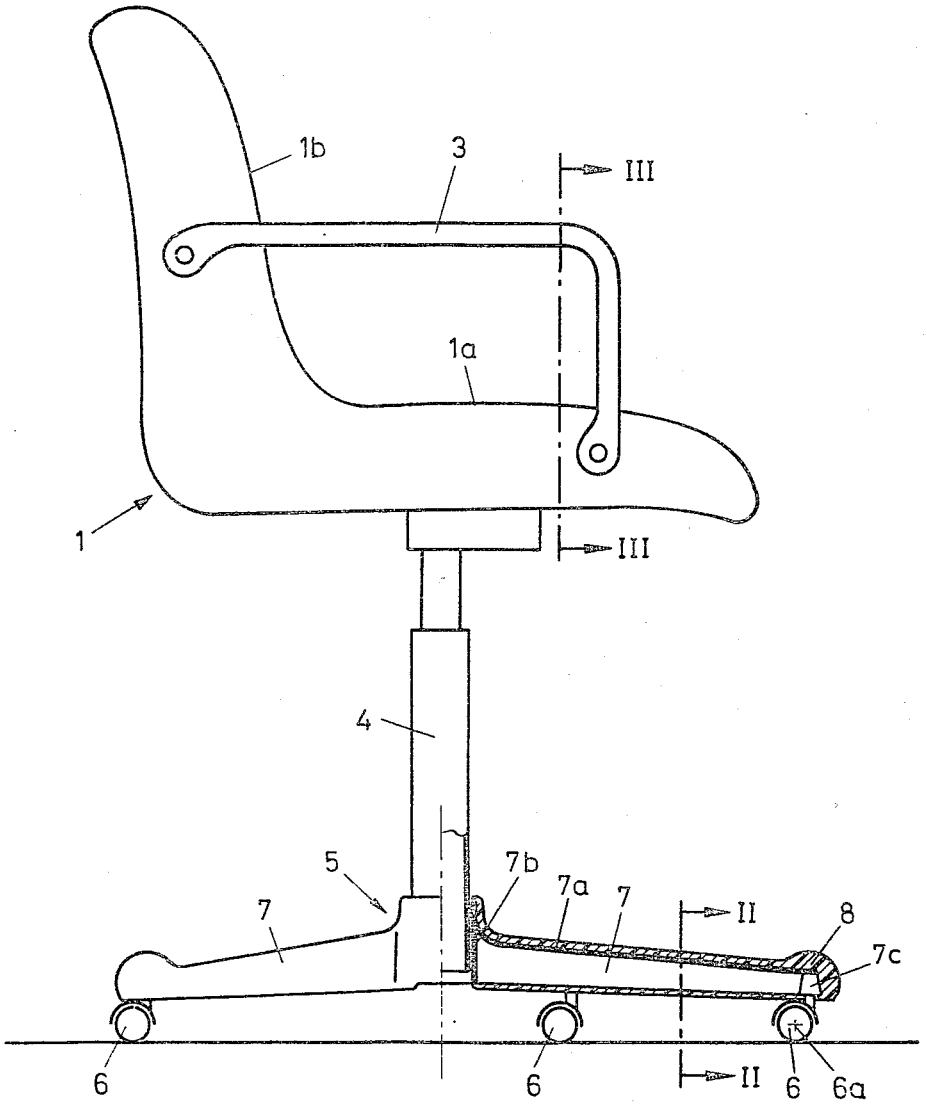
FIG. 1 shows a side view of an arm chair constructed in accordance with the present invention, with one projecting foot thereof shown in cut-away.

The chair construction shown in FIG. 1 comprises a seat member or bowl 1 including a generally horizontal seating surface 1*a* and a generally vertical molded backrest 1*b*, and armrest 3, a central support column or pedestal 4, a star-shaped base member 5, and casters 6 mounted on the outer extremities of radially projecting feet 7. Each foot 7 comprises an elongated structural support member 7*a* rigidly secured at its one end to a central hub 7*b* by welding or the like and housing a mounting member 7*c* at its outer extremity for rotatably receiving the pivot post of a caster 6 in a vertical manner. The pivot post of each caster is displaced from the roll center 6*a* thereof in a known manner such that the center 6*a* always swings behind and trails the pivot post during movement to ensure straight and even travel.

Figure 2:
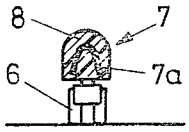
FIG. 2 shows a sectional view taken along lines II—II in FIG. 1.

Each support member 7*a*, the central hub 7*b* and each mounting member 7*c* are completely encased by a protective cushioning layer 8, as seen from the cut-away portion of FIG. 1 and in FIG. 2, with the exception of the apertures for the caster pivot posts and for the insertion mounting of the central support column 4. The support members 7*a* are each configured from sheet metal or stock bent in the shape of an inverted U, and the cushioning layer 8 completely surrounds each support member over its entire length and fills its open interior space.

Figure 3:
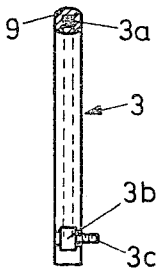
FIG. 3 shows a sectional view taken along lines III—III in FIG. 1.

The armrest 3, as best seen in the sectional view of FIG. 3, comprises a central support rod, tube or channel 3*a* provided with a bushing 3*b* at each end for accommodating and spacing a mounting screw or bolt 3*c*. The support rod or the like 3*a* is similarly completely encased on all sides with a protective cushioning layer 9, except for the apertures for the screws or bolts 3*c*.

The central support rod or the like 3*a* and the support members 7*a* of the feet 7 may be fabricated from steel or aluminum materials, and the cushioning layers 8, 9 may be soft foamed polyurethane or the like. It is thus easily seen that any striking or impact against the exposed parts of the chair, such as the base member 5, feet 7, and armrests 3, cannot result in any significant damage to the occupant, walls or furniture owing to the encasement of such parts in a layer of cushioning plastic material. Further, and of significant importance, during the manufacture or fabrication of the structural members 3*a*, 7*a*, etc. it is not necessary to employ any costly and time consuming finishing processes to remove and polish surface burrs, sharp edges, waste trimmings or drippings, etc. as such sharp edges and blemishes will be completely encased and neither pose any accident hazard nor aesthetically detract from the external appearance of the chair.

It would be possible and fully within the scope of the invention, to encase only the end portions of the radially projecting feet 7 or only their tops and lateral or side surfaces. In such case, however, it would usually be necessary to employ some additional measures or means to fully adhere or attach the cushioning layers to the metallic surfaces. Similarly, it would only be necessary to encase the extreme ends or tips of the feet 7 to protect adjacent furniture or wall surfaces against impact damage, but such limited encasement would then expose the occupant to potential injury or footwear damage from the unencased portions.

As mentioned above, the protective cushioning layers 8, 9 may, for example, be soft foamed urethane, which has the characteristic of forming a relatively smooth, attractive, and closed pore surface during foaming. Furthermore, polyurethane readily accepts a number of dye mixtures and compositions whereby the cushioning layers may be evenly and homogeneously colored in a desired manner.

What is claimed is:

1. A chair construction including a seating member, armrests, a plurality of radially oriented foot projections, and a support column connecting the foot projections to the seating member, characterized in that the armrests and foot projections comprise U-shaped members stamped and formed from sheet metal, all of the portions of said armrests and foot projections which are exposed after assembly of said chair construction being completely, permanently and unremovably encased prior to said assembly with a layer of soft elastic material.

2. The chair construction of claim 1 wherein the layer of soft elastic material comprises foamed plastic.

3. The chair construction of claim 2 wherein the layer of foamed plastic material comprises polyurethane.

4. The chair construction of claim 1 wherein the layer of soft elastic material comprises molded foamed plastic.

* * * * *